US005459301A

United States Patent [19]

Miller et al.

[11] Patent Number: 5,459,301

[45] Date of Patent: Oct. 17, 1995

[54] CYCLIC MICROWAVE TREATMENT OF PRESSED GARMENTS

[76] Inventors: Alan E. Miller, 531 Salem Woods Rd., Marietta, Ga. 30067; James L. Miller, 10355 W. Hazelwood, Phoenix, Ariz. 85039

[21] Appl. No.: 182,833

[22] Filed: Jan. 19, 1994

Related U.S. Application Data

[63] Continuation-in-part of Ser. No. 26,296, Mar. 4, 1993, abandoned.

[51] Int. Cl.[6] ..... H05B 6/68

[52] U.S. Cl. ..... 219/679; 219/700; 219/711; 219/718; 8/115.52; 223/51; 223/57

[58] Field of Search ..... 219/681, 710, 219/711, 718, 700, 679; 8/115.52, 115.53; 34/260; 223/52, 57, 51

[56] References Cited

U.S. PATENT DOCUMENTS

| | | | |
|---|---|---|---|
| 3,573,858 | 4/1971 | Moussalli . | |
| 3,765,580 | 10/1973 | Wilsker et al. | 8/149.3 |
| 3,846,845 | 11/1974 | Englert et al. | 8/116.1 |
| 3,849,169 | 11/1974 | Cicione et al. . | |
| 4,108,748 | 8/1978 | Portnoy et al. . | |
| 4,277,242 | 7/1981 | McLaren . | |
| 4,304,564 | 8/1981 | Frick, Jr. et al. . | |
| 4,323,624 | 4/1982 | Hunsucker et al. . | |
| 4,334,136 | 6/1982 | Mahan et al. | 219/681 |
| 4,401,688 | 8/1983 | Garnett et al. . | |
| 4,553,011 | 11/1985 | Nakata et al. | 219/711 |
| 4,956,532 | 9/1990 | Koch | 219/711 |

*Primary Examiner*—Philip H. Leung
*Attorney, Agent, or Firm*—James Creighton Wray

[57] ABSTRACT

Pressed garments are treated with microwaves to activate chemicals without heating the garments, resulting in permanent creases without fabric damage. An apparatus controls the process or curing cross-linking agent impregnated cellulosic fabric with microwave energy. The application allows finite control of the curing process necessary to impart a proper cure of wrinkle free fabric. The garment surface temperatures are continually remotely sensed. The microwave energy is cycled on and off so as not to overcure, avoiding loss of fabric memory and avoiding hot spots or burned fabric.

28 Claims, 5 Drawing Sheets

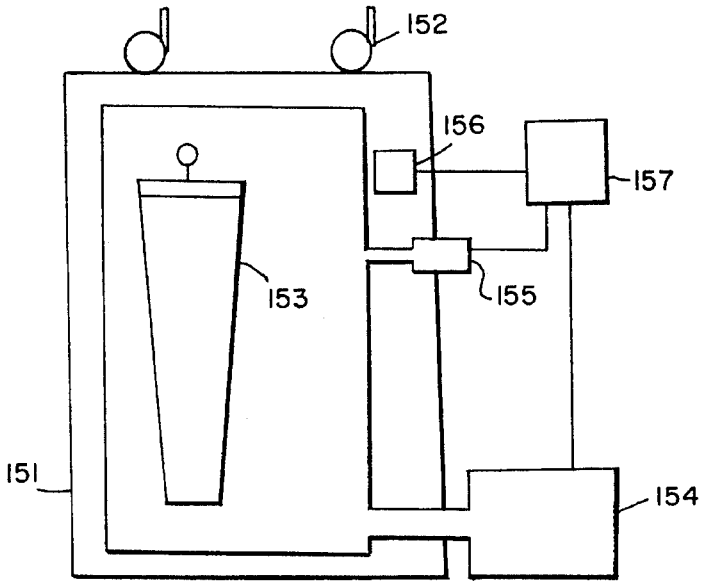
FIG. 13
FIG. 14
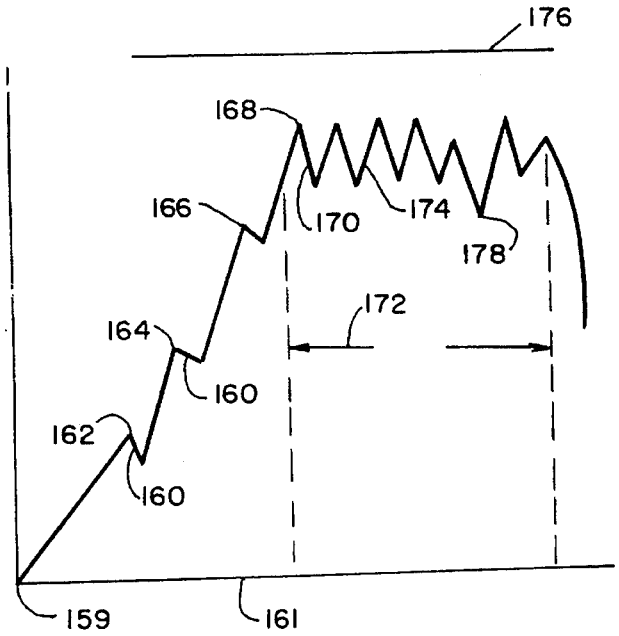

CYCLIC MICROWAVE TREATMENT OF PRESSED GARMENTS

BACKGROUND OF THE INVENTION

This a continuation-in-part of application Ser. No. 08/026,296 filed Mar. 4, 1993, now abandoned.

This invention relates to apparatus for controlling the application of microwave energy to chemically treated cellulosic fabric.

Processes have been developed in the textile industry to try to chemically treat fabric in an aqueous solution of poly functional/agent so as to impart a memory of wrinkle resistant capability. The curing process or the application of various forms of energy has been given much attention. The application of too much heat results in severe degradation, hot spots or burned areas and yellowing of the monomers or cross-linkable polymers, particularly in light colored garments or fabric. Too little heat energy applied results in a less than desirable wrinkle resistant capability after very few washes.

In U.S. Pat. No. 3,846,845, Englert et al., there is described a method of curing chemically treated cellulosic fabric with microwave as the primary energy source for affecting the cure. While this process has distinct advantages over the high temperature, long duration cure ovens most commonly used in the industry, it has not been used or has not achieved commercial success or acceptance.

For three decades the apparel industry has worked to give natural fibers and blends an easy care finish. That finish would allow the consumer to launder and wear the garment with little or no ironing.

Several chemicals are available to impart an easy care property to fabrics. The only way users have been able to set the "crease" or the smooth fabric appearance and property is to bake the finished, pressed garments in either an enclosed oven or one designed on the tunnel concept that allows continuous movement of garments.

That heat, usually 325° for 10–15 minutes, sets the creases and fabric smoothness, but also the heat breaks down the fiber, which shortens normal wearing life.

The old heat set process was first developed in the 1960's. It was subsequently abandoned until recently. The chemicals, and the high heat necessary to activate them, broke down the fibers so much that they lost their tensile strength, as much as 40% in most processes. That reduced the life of the garments. In that process the garment has to be pressed as wanted to look when "finished". That required an oven in a facility that also could do the pressing. Once the finished press was done, movement would or could cause wrinkles that would become permanent, once cured in the oven. The high cost of installing process ovens made them available only to a few producers. The time it takes to "bake" in the conventional ovens, 10–15 minutes, also limits their ability to do the number of units that may be needed.

The garment industry is a highly competitive industry. Costs must be carefully controlled. High costs of installation, costs of space for ovens, costs of isolating workers from the high oven heats, and costs of operating the ovens, all translated to higher garment unit costs. Permanence of oven installations made factory modernization more difficult.

Heat treatment ovens are large and expensive to build and to operate. Once built, the ovens cannot be conveniently moved. Factory designs and locations are made inflexible, and building or relocating heat treatment ovens is a major cost in moving and relocating and redesigning garment production facilities.

A need exists for a press setting method and apparatus that will economically and effectively permanently set creases and fabric smoothness without destroying garment life and without restricting factory design and location.

SUMMARY OF THE INVENTION

The present invention gives the same properties that are gained by the old method. The fabrics and the garments are treated in much the same way with the chemicals currently in production. The garments are passed through microwaves to activate the properties of the chemicals. The time is about one minute. No damage is done to the fabrics, and the cost savings are substantial.

The microwave units of the present invention can be easily moved to a plant facility that has the need and capability for it. The old "ovens" were huge, and once installed with their other inherent feature, asbestos, could not be moved easily, efficiently or economically.

The present process applies to every natural fiber and to natural and synthetic fiber blends, in all genders of apparel manufacturing.

The closest prior art process is the use of convection heat in an oven for a stated period of time.

Microwave processors of the present invention may be built and marketed to allow the use in many plants that manufacture men's, women's and children's garments. The initial price of the present unit, plus the savings in energy cost, would amount from about 30 to 40 cents per garment based on current costs. As energy costs increase, savings will increase. That is in addition to costs that may be saved by facilitating plant improvements and redesign.

Most apparel manufacturing plants can use the ability to impart these easy care properties on pieces of wearing apparel that could then be laundered at home without any pressing necessary. The invention is a major improvement in apparel manufacture by overcoming the problem of breaking down the fibers. The consumer can save by having long life garments and by not having to pay for commercial laundering.

The invention resides in apparatus and processes for the rapid set or activation of durable press finishing chemical treatments for finished apparel garments, made of both cellulosic and synthetic garment materials.

A process of the invention for activating or causing permanent set or durable press finishing for garment materials, in the finished garment state, results in a long lasting wrinkle free set. Garment materials such as cellulosic fibers and synthetic fibers are treated with a dielectric durable press finishing crosslinking chemicals. Microwaves will rapidly activate the press finishing, providing crosslinking, with no heating, degradation or discoloration of garment materials. Most known permanent press set processes use chemical and catalysts that are dielectric, hence the process entails wide application.

Preferably the new microwave process rapidly sets or activates durable press finishing treatments for garment materials in finished garments made of fibers such as cellulosic fibers and blended fibers.

The present invention relates to the setting or activation of the materials used to treat fabrics, that result in the treated fabrics taking on a durable permanent set or memory, commonly known in the trade as wrinkle free. The present invention particularly relates to a process for quickly activating chemicals and catalysts used in treating fabrics by exposing treated fabric to microwaves, rapidly resulting in crease retention and wrinkle free fabric with minimal temperature imparted to the fabric.

The present invention relates to the setting or curing of durable finishing crosslinkers quickly. This process can be accomplished either in a batch process or in a continuous process.

The present invention is directed to processes for the rapid low temperature curing of fabrics and garments treated with crosslinkers, resulting in permanent press garments that retain their memory after washing, resulting in a care free, no-iron garment which is very desirable to the apparel industry, and to the consumer. Since cellulosic and most synthetic fibers used in garment fabrics are non dialectic, they do not react to microwaves. Thus, the fibers do not rise in temperature during the irradiating-curing process. That results in the fabrics being cured at low temperatures. Thus, no fabric degradation or discoloration results. Dielectric crosslinkers and catalysts absorb the microwave introduced and are activated at low temperatures, resulting in permanent press garments.

An important element of this invention is the rapidity with which the cure results. The rapid cure occurs in seconds, as opposed to the 10–15 minutes in prior art elevated temperature convection ovens. This invention results in much higher capacity at much lower energy requirements. An additional essential element of this invention is the lower temperature occurrence which avoids fabric degradation and discoloration.

It is an object of the present invention to provide an improved process using microwaves to rapidly activate or cure durable press finishing crosslinkers. It is also an object of the present invention to provide a process which requires substantially less energy as a result of the cure occurring rapidly at extremely low temperature to the fabric, resulting in little degradation of fiber and no discoloring. It is further an object of the present invention to provide a process which is simple and economical by comparison to prior processes using elevated temperatures and immobile curing ovens.

A principal object of this invention is the capability of controlling the cure process.

Another object of this invention is the providing of a capability of applying significantly large doses of microwave energy at controlled rates to make the process commercially viable for production. Another object is to avoid over and under cure in fabric, a common problem in all methods of curing.

An object of this invention is to provide time-temperature related sequencing and control of the application of energy forms necessary to impart an acceptable memory of cure.

An additional object of this invention is the provision of the capability of making the process commercially acceptable for production, and providing reliability of product output and user friendly manufacturing operations for the workers who have the responsibility of operation of the apparatus but lack the overall knowledge of the thermodynamics, chemistry and electronic control employed and necessary to achieve the targeted results.

Many of the objects, features, benefits and advantages will be obvious to those skilled in the art form from the following descriptions and drawings.

These and further and other objects and features of the invention are apparent in the disclosure, which includes the above and ongoing written specification, with the claims and the drawings.

BRIEF DESCRIPTION OF THE DRAWINGS

FIG. 13 is a frontal view is a frontal view of what a typical microwave chamber may look like.

FIG. 14 represents a graph depicting graphically what occurs with respect to controlling times and temperatures so as to effect full cure and avoid hot spots.

DETAILED DESCRIPTION OF THE DRAWINGS

Figure 1:
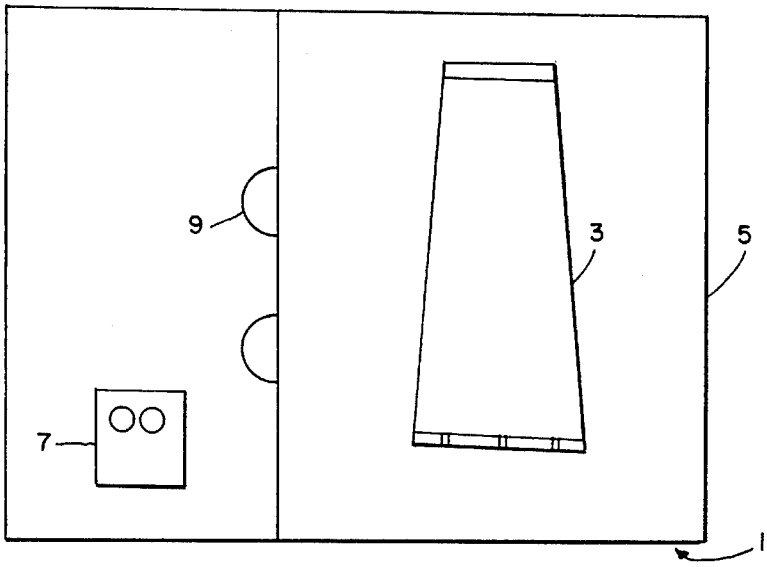
FIG. 1 is a schematic representation of garments made of fabric being batch treated with microwaves curing a dialectic permanent press chemical product.

Referring to FIG. 1, a simplified apparatus for batch treatment of garments is generally indicated by the numeral 1. Garment 3, in this case trousers, which has been chemically treated, is placed inside an enclosure 5. On/off control 7 energizes microwave magnetrons 9, activating the chemicals and making the garment retain its crease.

Figure 2:
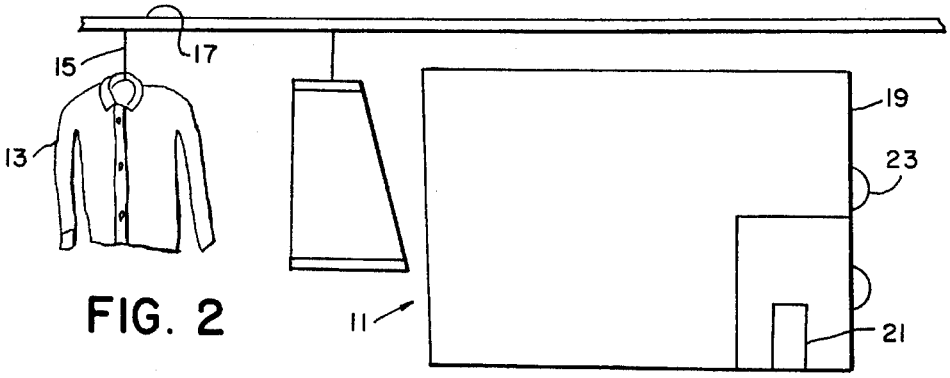
FIG. 2 is a schematic representation of a microwave oven through which the treated fabric or garment is conveyed to cure the product.

A continuous process, generally indicated by the numeral 11, is shown in FIG. 2. Garments 13, which have been chemically treated and pressed, are suspended on hangers 15, which are connected to a conveyor 17 for moving through the chamber 19 in a continuous uniform direction. Controls 21 energize magnetrons 23, which direct microwaves toward the garments within the enclosure 19.

Figure 3:
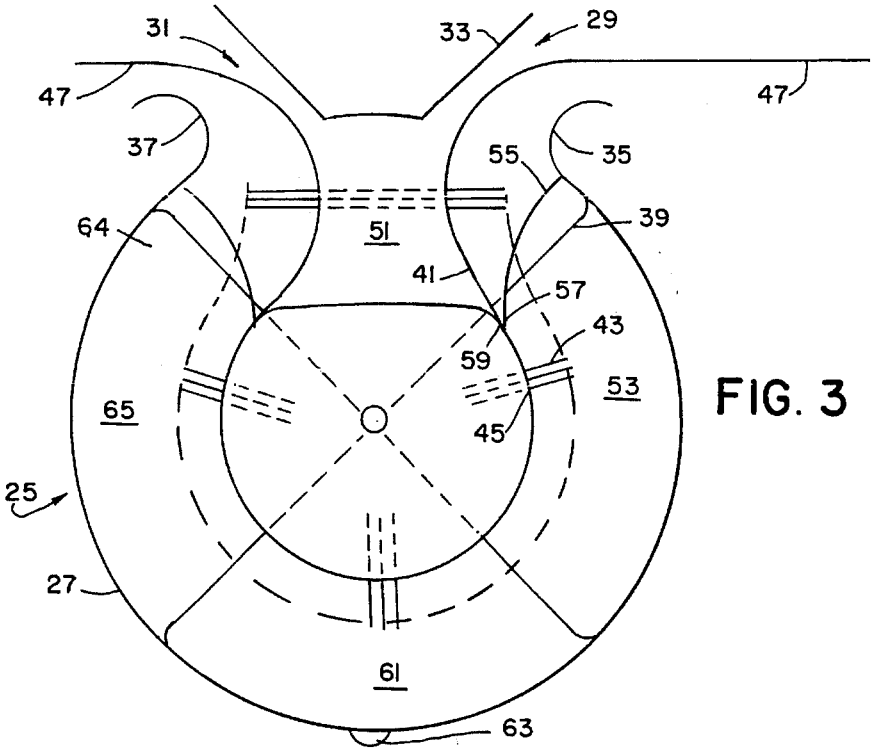
FIG. 3 is a schematic representation of a cylindrical microwave enclosure used in the present invention.

In one form of a continuous process apparatus as shown in FIG. 3, a circular chamber is generally indicated by the numeral 25. The chamber has a generally cylindrical wall 27 with an inlet opening 29 and an outlet opening 31. The inlet and outlet openings are surrounded by people barriers 33, 35 and 37. The cylindrical wall is supported by cross frame members and has a revolving door 39 beneath the conveyor loop 41. Garments 43 are suspended on hangers 45, which are connected to the conveyor 47. As the conveyor moves the garments inward, they pass in a segment bounded by adjacent doors 39 through an in and out chamber 51 and an antechamber 53. An upper wall 55 may have flexible opening positions 57 and 59 to pass the hangers. The garments pass into the microwave chamber 61, where chemicals on the garments are activated by microwaves from the magnetron 63. The garments pass outward through chambers 64 and 51 as they continue along the conveyor 47.

Figure 4:
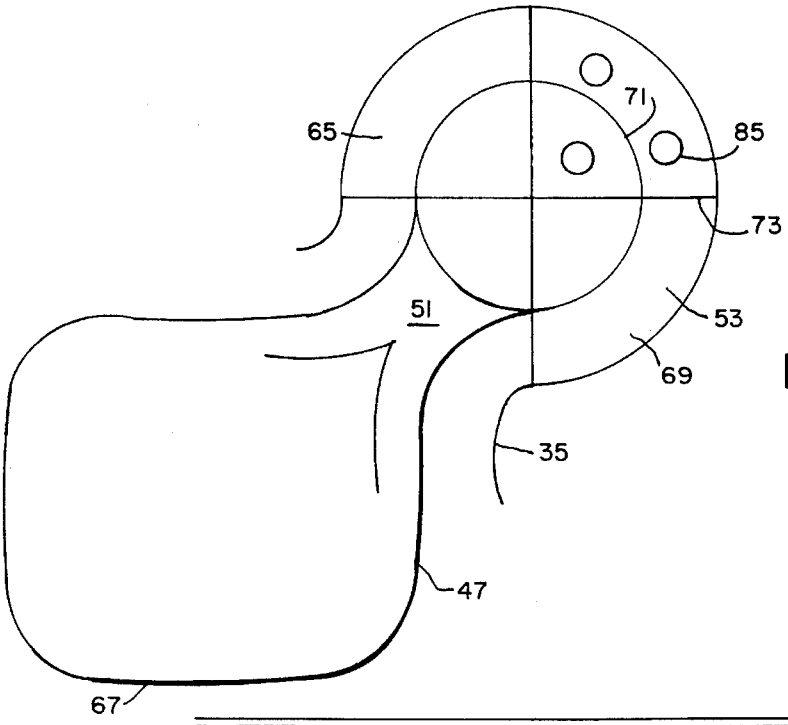
FIG. 4 is a schematic top representation of a system using the enclosure of FIG. 3.

FIG. 4 shows a schematic representation of the system shown in FIG. 3. The conveyor 47 forms a loop 67 on which pressed garments are hung and from which microwave treated garments are removed. The outside top 69 is stationary, and the inside top 71 rotates with the doors. Gas is evacuated from chamber 65. Chamber areas 65, 53 and 51 form microwave traps. Doors 73 rotate with the inside top 71 so that at least one door 73 always separates the microwave chamber 61 from the outside.

The doors and inner top rotate at about one to two rotations per minute.

Figure 5:
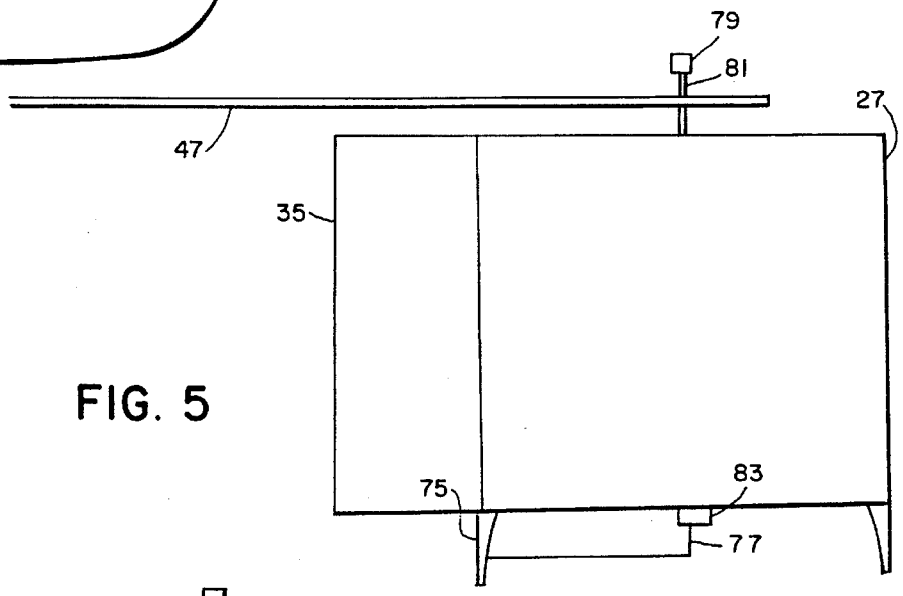
FIG. 5 is a side elevation of the cylindrical chamber of FIGS. 3 and 4.

FIG. 5 shows a side elevation of the chamber shown in FIG. 3 and 4. Cylindrical wall 27 is supported on legs 75. A drop-out chamber 77 is provided beneath the cylindrical wall. Curved barrier 35 is joined with the cylindrical wall 27. A motor 79 has a shaft 81 which rotates the doors and inner top. Alternatively, 79 may be a bearing, and a motor 83 may be provided at the bottom. Downward directed magnetrons 85 are provided as shown in FIG. 4.

Figure 6:
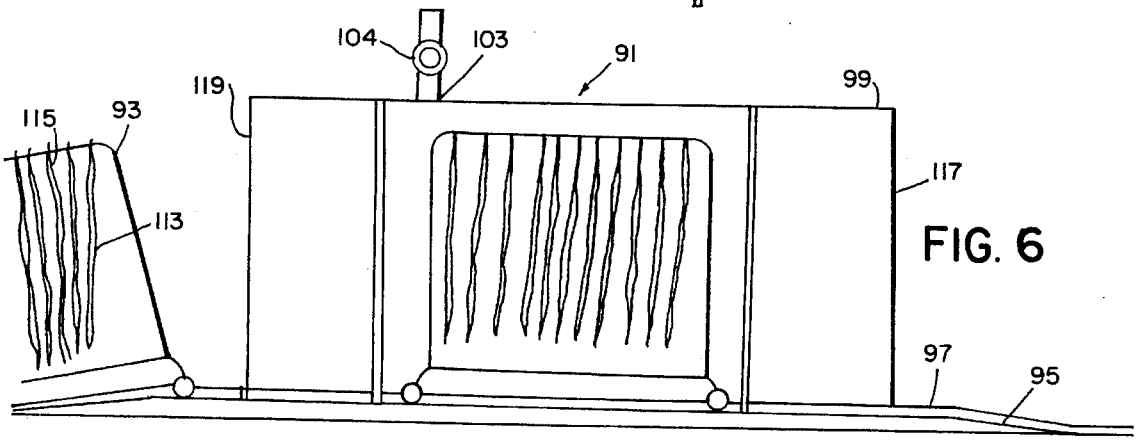
FIG. 6 is a schematic representation of a microwave chamber used with racked garments.
Figure 7:
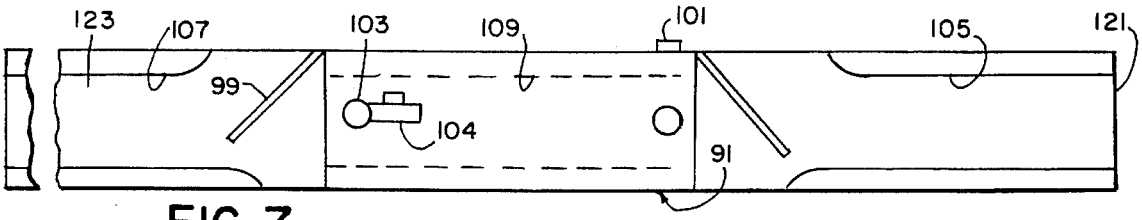
FIG. 7 is a schematic representation of the chamber apparatus of FIG. 6.

A preferred chamber 91 for use with garment racks 93 is shown in FIG. 6. The chamber may be about 8 feet long and about 6½ feet high, and about 3 feet in width. Ramps 95 at opposite ends of the chamber are optional. Guide rails 97 may be provided within the chamber and along the doors 99, which are opened closed by air cylinders. An air inlet 101 has a microwave screen. A microwave screen is used on the exhaust 103. The chamber 91 may be charged with a hot gas through this inlet 101 to further augment the cure and reaction of the microwave energy. The inlet temperature may vary from 250° F. to 450° F. Curing time will vary, from 15 seconds to 3 minutes, depending on the specific catalyst and the product being treated. The gas injected may be of a catalytic nature to further enhance the desired cure. A purge sequence may be installed to assure exhaust of by-products of the cure procedure, through the exhaust outlet 104.

The purge sequence could be from 5 to 15 seconds. The chamber 91 may be double walled or insulated to reduce any high temperature exposure outside the cabinet. An exhaust fan 104 will be capable of rapidly purging the chamber of heat and any vapors.

Guide rails 105 and 107 are shown outside of the chamber 91 for guiding the garment rack wheels. Garment rack guides 109 are provided inside the chamber for guiding the wheels. In one form of the invention, garments 113 are hung on the hangers 115 on rack 93. The door 117 is opened and door 119 is closed, and the rack is rolled into the microwave chamber. Closing door 117 enables the start of a microwave cycle, and the microwaves continue to treat the garments 113 inside the chamber 91 for about one minute. Thereupon door 119 is opened, the rack 93 is pulled out of the chamber, and door 119 is closed. Door 117 is opened, a new rack 93 is rolled into the chamber, and door 117 is closed, cycling the system.

The system may be automated with a conveyor for pulling the racks through the chamber, with personnel simply loading the loaded racks into inlet side 121, and for pulling the rack with the completed garments from exit side 123.

Figure 8:
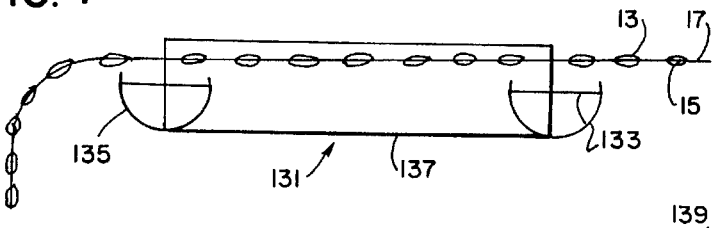
FIG. 8 is a schematic representation of a microwave chamber with revolving door microwave traps at opposite ends.
Figure 9:
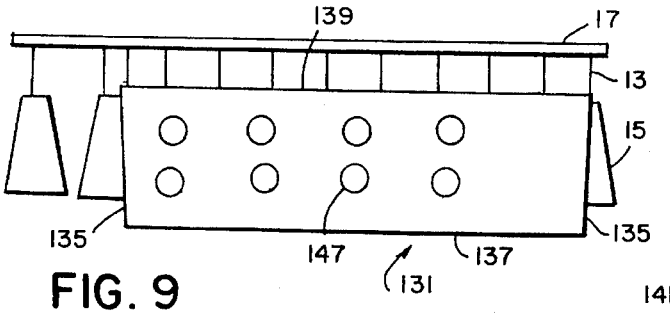
FIGS. 9 and 10 are side and end elevational schematics of the chamber shown in FIG. 8.
Figure 10:
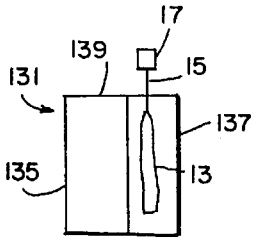
Figure 11:
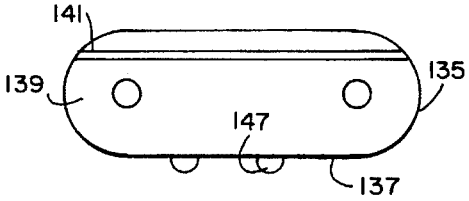
FIG. 11 is a top plan schematic of the chamber shown in FIG. 8.

FIG. 8 shows a top view of a modified form of the invention in which a chamber 131 is formed with rotating doors 133 to prevent egress of microwaves. The doors rotate within cylindrical walls 135 at opposite ends of the rectangular walls 137 of the chamber. Garments 13 are suspended on hangers, and the doors 133 rotate between adjacent garments or groups of garments, while the garments move along the conveyor 17, as shown in FIG. 9. An end view of chamber 131 is shown in FIG. 10, and a top view of the closed chamber is shown in FIG. 11. A microwave shielding top wall 139 and a similar bottom wall are provided in addition to the side walls 137 and the semicylindrical end walls 135. A slot 141 is provided for the hangers.

Figure 12:
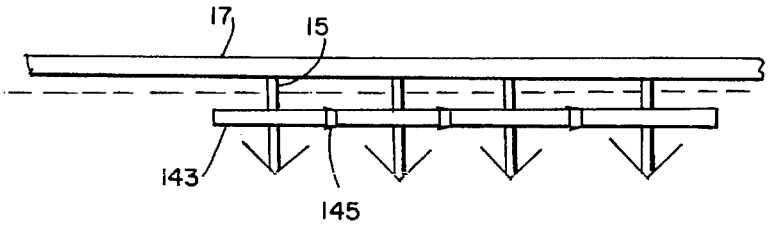
FIG. 12 is a detail of the hangers with microwave shields.

As shown in FIG. 12, one form of the hangers have microwave reflectors 143, with overlapping flaps 145 to prevent microwave radiation from extending through opening 141. Microwave generating magnetrons 147 may be positioned on the walls 137 of the chamber.

In one form of the invention, as shown in FIGS. 8–12, the conveyor may move at about from 9 to 10 feet per minute.

One garment may require about 500 watts of power for about 60 seconds.

With a faster linear speed or a shorter chamber, a dwell time might be reduced to 38 seconds or from about 30 to 40 seconds, and a microwave power might be increased to 800 watts.

In the preferred embodiment of the invention, the chambers have an inlet and an outlet door and are sized to receive an entire garment rack with garments. Exhaust outlet and fresh air inlet maintain a flow through the batch chamber when the doors are closed. The outlet and inlet are shielded. The chamber is tightly sealed by the doors to provide uniform treatment of the fabrics and to avoid microwave leakage. The guide rails provide ease of handling the garment racks. By receiving the entire garment rack, individual piece handling is eliminated in this stage of manufacture.

The two door feature accommodates higher capacities. Receiving an entire garment rack reduces cost and time and chance of wrinkles after the ironing process and before treatment with the microwave. The exhaust outlet and the fresh air inlet allow the chamber evacuation of gases which may be produced during the crosslinking process.

A tightly sealed chamber avoids microwave leakage and assures uniform treatment of the fabric and the crosslinking products. Garment guides expedite movement of the garment racks. Different fabrics and different crosslinkers may have varying power requirements and time for setting. Thus the power level and time may be adjusted to accommodate those variables, as well as the garment size and count in each rack.

One example of suitable chemicals for use in the present invention is Fixapret™ supplied by BASF Corporation, Chemicals Division, Parsippany, N.J.

Fixapret's™ chemical formula is $C_5H_{10}N_2O_3$ or 4,5-dihydroxy-1,3-dimethyl-2-Imidazolidinone used with catalyst 10, also provided by BASF Corporation, which is a mixture of inorganic salt solution in water containing magnesium chloride, calcium glycolate and water.

The result after curing for about 1 minute with 500 watts microwave in a 6½×3×8 foot chamber is a garment with a crease set. After washing, a consumer may have to give the garment a slight press to remove surface wrinkles, but the creases are permanent. The task is very simple. The wrinkles would probably relax and come out with ordinary body temperature and moisture, but a slight touch-up with a cool or medium iron is useful for a crisper look, as in the case of all easy care, permanent press products.

It has been determined in accordance with this invention that significant amounts of microwave need be applied to attain commercially acceptable production rates. Once essence of this invention is the ability to control power application finitely. Microwave energy focuses on heating dielectric materials. Electrically conductive materials are heated faster. Finished garments impregnated with an aqueous solution of functional polymeric agent have a variety of components of varying dielectric characteristics. Some of these are cotton, which is dielectric and which is prone to burn. Buttons, and other trim, depending on their composition can range from high dielectric to very low. Zippers made of brass heat quickly, while those made of plastic are slow to heat. Threads and thickness of seams also vary dielectrically, as do the various cross-linkers and catalysts used in the aqueous solutions. Most are catalyzed with metallic based chemicals, which may heat more rapidly.

Recognizing the complexities of thermodynamics of these varied materials and the control of applied energy are parts of this invention.

Englert et al., U.S. Pat. No. 3,846,845, teaches that wrapping and insulating the garment against loss of heat during the required time to attain cure is necessary. It further teaches that hot spots or burns can occur and must be avoided by preferably moving the garment and using a microwave stirrer.

An embodiment of this invention and a third alternative which can be employed to attain cure and avoid hot spots is the finite control of the application of microwave energy.

In FIG. 13 several pair of trousers 153, which have been treated with a wrinkle-resistant chemical solution, are suspended in the microwave cure chamber 151, equipped with several magnetrons 156 of 30 Kw, depending on cabinet size in a static (hanging) mode. Additionally, the garment must be insulated from heat loss by enclosing it within a covering or by placing it in an environment which enables the garment to retain much of the internally generated heat. In a commercial application the latter is preferred, so as to increase production and minimize handling. A hot air source 154 is used to supply the proper temperature of induced air to control this heat loss insulating effect required for various garments and fabrics. The hot air induction fans 152 are monitored and controlled on/off so as to maintain a proper hot environment for curing. An infrared sensor 155, such as Mikron Series 67, is used to read surface temperatures to establish targeted temperatures during the cure process.

The infrared sensor should be focused to look through a 1½ inch diameter pipe 4.8 inches in length to minimize radio frequency (RF) leakage out of the cabinet, and to reduce RF interference of the sensor's signal.

Controlling rates of applied energy is accomplished through the control system 157 based on the sensed temperatures. It is necessary to shield the infrared sensor from RF as much as possible. Some filtering may be required to have a signal steady enough to control off and on switching of the microwave source.

A suitable filter can be described as follows:

The Allen-Bradley PLC is capable of and does read the temperature readings of the infrared sensor several times a second. These temperatures area a conglomeration of actual fabric temperatures read and erroneous or bouncing temperatures as a result of RF interference. The PLC is programmed to accumulate several of these temperatures, 20–40, and average them in order to have a good operating temperature to work with over a time span that will not cause overreaction to power adjustments. The result is a good steady temperature to work with and control from. Those practiced in the art also know that a well shielded coaxial cable also helps reduce RF noise.

A programmable controller 156, such as an Allen Bradley Series 500, is used. A PLC with multichannel PID loops (proportional integral directive) allows for high sensing of operating parameters and multi-function output control, which can be accomplished in nanoseconds. When high energy levels of microwave power are used, close tolerance temperature monitoring and fast control reaction are essential to maximize production while eliminating hot spots or overhead conditions which result in discoloration or the burning of the garments.

It is noteworthy to look at the variety of product to be placed in a cure chamber in a manufacturing or processing facility. Cotton pants of different fabric weight and different weaves may be used. Shirts are typically made of much lighter, more delicate fabrics. Various colors react differently when the aqueous solution is applied. Part of this is the difference in dyes that are used. Polymeric agents vary and react at different rates and at different temperatures. Severe yellowing, such as bright banana yellow, results instantly with too high temperatures. Those practiced in the art know that those variables are not predictable, but with close tolerance control can be empherically determined and controlled.

FIG. 14 is a graphical display of time/temperature results necessary to perform a cure cycle within acceptable parameters. The starting temperature and begin time 159 is the begin point of the cure cycle. Power is applied and timing or total cycle time 161 is started. The temperature is allowed to rise to a predetermined temperature 162, at which time power is shut off for a rest period 160 of x seconds. This rest time is adjustable on the PLC controller. A rest period is essential to allow hotter areas to dissipate some of the heat so as to avoid hot spots. After the rest period 160 has elapsed, power is brought back on and increases the fabric surface temperature. Temperatures are incrementally increased to a predetermined temperature 164, at which time power goes off for another rest period 160. At the end of this rest period, power is brought back on and elevates the incremental increase to temperature 166, when another rest 160 is called for. Power is again restored and this cycle is repeated until cure temperature 168 is attained. At that time, power is turned off until the surface fabric temperature attains minimum cure temperature 170. Counting of cure time 172 commences. When high temperature cure limit 168 is attained, power goes off until the minimum cure temperature 170 is sensed, at which time power comes back on for an incremental amount 174 of seconds.

After the time span 174 has elapsed, power goes off until minimum cure temperature 170 is again sensed, at which time power is restored for the incremental amount 174 of seconds. This cycle is repeated until time 172 is satisfied. At that time, the exhaust fans may be turned on to evacuate the chamber. At this point the cycle is complete and the operator is signalled. A high temperature safety cutoff 176 insures that excessive temperatures are not experienced.

If all garments were always the same color, same fabric and the same size, control would not be a problem. This is just not the case in the apparel industry, which has caused what has been learned to date to be abandoned. A temperature 178 lower than the low temperature limit 170 is noteworthy. That occurs when most of the aqueous solution properly cures. Lowering of the garment temperature below the "low limit" temperature 170, even though full power is being applied, is an indication that most of the cure has taken place. Cure temperature is maintained for some additional time to assure maximum cure is attained on more difficult areas such as cuffs, pleats and collars.

The various working temperatures 162, 170, 168 and 176 are all selectable depending on the load being cured. The rest period 160 is also selectable and may require increasing when multiple layer garments or brass zippers are used. Cure time commencing at 180 and ending at time 182 equals cure time 172, which is the time at which the garments are held at the cure temperature range 170 to 168. Total cycle time 184 commences with initial power on 159 and cycle complete 186.

The induction fans 152 in FIG. 13 will come on with the start of the cycle 159, FIG. 14, and will come on and go off based on a desired selectable Hi-Lo temperatures setting determined for chamber ambient temperature necessary for any particular garment processed.

The apparatus of the invention is capable of reading garment surface temperatures using infrared (IR) detectors, which are well shielded from RF and are filtered so as to have a readable usable temperature reading. The controller is capable of acting upon input temperatures and is capable of controlling ambient internal chamber temperatures within predetermined selectable temperatures needed to effect good cures without hot spots.

Various materials and various dielectricity must be addressed in order to effect proper cure while avoiding hot spots, discoloration or burns.

A variable ambient temperature is maintained within the cure chamber to minimize heat loss and to dissipate heat build up in highly heated areas of the garments.

Incremental temperature increases with appropriate rest periods allow for high production curing while avoiding hot spots.

Appropriate cure temperatures are maintained. Temperatures within high temperature limits and low temperature limits are maintained for the necessary cure duration of the fabric and curing agent, taking into account various fasteners, garment shapes, fabrics, colors and load sizes. Cure chamber temperatures are maintained by the cycling heat.

Excessive high temperatures are avoided by a safety secondary high temperature cutoff. A high temperature runaway condition cannot develop.

The apparatus is user friendly to those in the manufacturing process who lack the technical skills of process understanding, yet who must produce treated garments at economically viable levels of production The apparatus is capable of controlling all process parameters through the cure of garments, up through and including notifying operational people of process times and high temperatures, and termination of the entire cycle.

Figure 15:
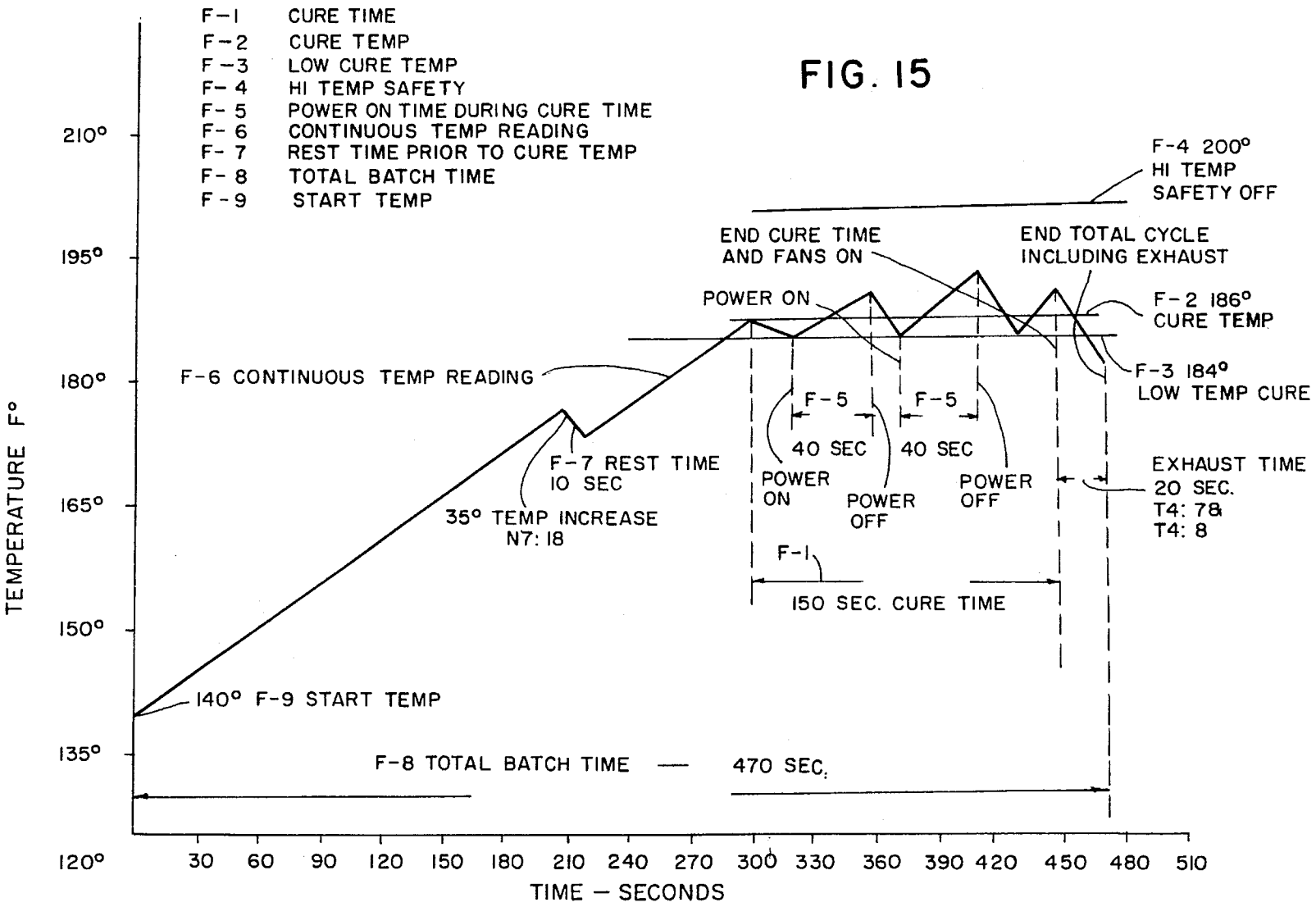
FIG. 15 is a graph of sequence of operation time versus temperature with the various functions.

In one example, as shown graphically in FIG. 15, clothes are loaded in a chamber at about 140° F., and heaters, blowers and microwave generators are turned on. Blowers are turned off when hot air fills the cabinet. Temperatures ramp up to about 175° F. in 210 seconds. The microwaves are turned off for ten seconds, and clothing surface temperature drops to a few degrees. The microwaves are turned back on. In 80 seconds an F-2 cure temperature of 186° F. is reached. Microwaves are turned off for about ten seconds until surface temperatures drop to the low cure temperature F-3 of 184° F. The microwaves are cycled on for 40 seconds, reaching a temperature above the 186° F. mark. Microwaves are turned off until temperatures reach the F-3, 184° F. Microwaves are turned off until temperature drops to F-3, and then on again until 150 seconds following the first reaching of 186° F. Microwaves are turned off and fans are turned on to exhaust the chamber. The total batch time is 470 seconds, 10 seconds under eight minutes, which includes a 20 second exhaust time and a 150 second, 2½ minute cure time at curing temperatures. A limit switch is set at 200° F. to stop microwave generators and heaters. Treated clothing which has been placed in a chamber for curing is ready for removal 470 seconds later.

The apparatus is capable of controlling energy sources, including microwave and induced hot gases, to produce on a consistent basis high quality, wrinkle-resistant garments and fabrics by virtue of proper temperature sensing and control, regardless of the many variables of construction, weight of fabric, color, attachments, layers or number of garments being cured.

While the invention has been described with reference to specific embodiments, modifications and variations of the invention may be constructed without departing from the scope of the invention, which is defined in the following claims.

We claim:

1. In garment treating apparatus which comprises a chamber, a closure for the chamber for opening to permit passage of garments into and out of the chamber, a support for supporting chemically treated garments in the chamber, microwave generators for generating microwaves in the chamber, and a controller for controlling temperature, the improvement comprising a temperature sensor connected to the controller and focused on surfaces of the garments for sensing garment surface temperatures in the chamber, the microwave generator connected to and controlled by the controller, and wherein the controller periodically ramps up garment temperatures with the microwave generators, periodically turns the generators off, and cycles the generators on and off when cure temperatures are reached, as sensed by the sensor.

2. The apparatus of claim 1, wherein the chamber is sufficiently large for receiving a rack of garments mounted on hangers suspended from the rack, and wherein the closure is a door which opens and closes to admit a rack into the chamber.

3. The apparatus of claim 2, further comprising one door for opening to admit a rack into the chamber and another door for opening for withdrawing a rack from the chamber for moving rack through the chamber in a uniform direction.

4. The apparatus of claim 1, further comprising guide rails connected to the chamber and a first ramp with guide rails connected to the chamber by the first door, and a second ramp with guide rails connected to the chamber near the second door, for guiding racks of garments into, out of and through the chamber.

5. The apparatus of claim 4, further comprising a microwave screened air inlet and a microwave screened exhaust outlet connected to the chamber for flowing air into the chamber and exhausting gas from the chamber.

6. The apparatus of claim 1, wherein the chamber has parallel walls along the chamber and cylindrical walls at the end of the chamber, and further comprising revolving door microwave traps at first and second ends of the chamber, a conveyor positioned over the chamber and hangers connected to the conveyor for moving garments through the revolving doors and through the chamber, and a microwave generator connected to the chamber for supplying microwaves within the chamber when the rotating doors are closed.

7. The apparatus of claim 1, wherein the chamber is cylindrical, and further comprising a large revolving door rotating within the cylindrical chamber for dividing the chamber into individual moving sections which move within the chamber, and microwave generators connected to the chamber for directing microwaves into the chamber and through garments moving through the chamber between the revolving doors.

8. The apparatus of claim 7, further comprising a garment conveyor positioned above the chamber and having a circular portion directly above the chamber, one section of the chamber being open for admitting garments to the chamber and withdrawing garments from the chamber along the conveyor as the rotating doors pass the open part of the chamber, other parts of the chamber being closed by the door and the circular chamber wall and upper and lower walls for preventing microwave egress from the chamber.

9. The apparatus of claims 8, further comprising a circular wall above the doors for movement with the doors and preventing upward egress of the microwaves.

10. In a method for treating chemically pretreated garments comprising placing chemically treated garments in a chamber, generating microwaves in the chamber for treating the garments using microwave generators, thereby exposing the garments in the chamber to the microwaves, the improvement comprising sensing the temperature of the garments using a temperature sensor focused on the garments, and controlling temperatures of the garments using a controller connected to the sensor and the microwave generators, the controller periodically cycling off the microwave generators for rest periods sufficient to prevent development of hot spots in garments.

11. The method of claim 10, further comprising treating garments with cycled on and off microwaves at about 800 watts for about 40 seconds.

12. The method of claim 10, further comprising treating garments with cycled on and off microwaves at about 500 watts for about 1 minute.

13. The method of claim 10, further comprising placing pressed garments on a rack, rolling the rack into the microwave chamber, closing the chamber, providing cycled on and off microwaves in the chamber, opening the chamber and removing the garment rack on which the pressed garments which have been exposed to the cycled microwaves are hanging.

14. The method of claim 13, the opening further comprising opening a first door, rolling a rack of chemically treated garments through the door into the chamber, closing the door, treating the garments with microwaves, cycling the microwaves on and off, opening a door, withdrawing the rack of garments and closing the door, opening the first mentioned door and repeating the method with another rack of chemically treated garments to be treated with microwaves.

15. The method of claim 14, further comprising guiding the racks with rails leading into and out of the chamber and within the chamber.

16. The method of claim 10, further comprising mounting the chemically treated garments on hangars suspended from an overhead conveyor, conveying the garments along the conveyor, passing the garments into a chamber, opening and closing rotating doors as the garments pass into and out of the chamber, exposing the garments to microwaves within the chamber, and repeatedly cycling the microwaves off and on while the doors are closed.

17. The method of claim 16, further comprising carrying microwave shields on the hangers above the garments for preventing upward egress of microwaves.

18. The method of claim 17, further comprising treating the garments in the chamber with repeated microwave energizations, repeatedly cycled off for rest periods as the doors open and close and as the garments are advanced through the chamber.

19. The method of claim 10, further comprising hanging the garments on hangers and suspending the hangers from a conveyor and moving the conveyor along a circular track within a circular chamber with large rotating doors extending across the chamber, dividing the garments into groups of garments with the doors, and sealing the chamber with the door from egress of microwaves, cyclically exposing the garments to microwaves within one section of the cylindrical chamber as the groups of garments move through that section of the cylindrical chamber, and as groups of garments move through the chamber.

20. The method of claim 19, further comprising moving an upper microwave shield with the doors.

21. The method of claim 20, further comprising evacuating and exhausting gas from the chamber.

22. In garment treating apparatus which has a chamber, a support for supporting chemically treated garments in the chamber, microwave generators for generating microwaves in the chamber, and a controller for controlling temperature, the improvement comprising a temperature sensor connected to the controller and focused on surfaces of the garments for sensing garment surface temperatures in the chamber, the microwave generators connected to and controlled by the controller, and wherein the controller cycles on and off the generators when predetermined selectable temperatures needed to effect good cures without hot spots are sensed.

23. The apparatus of claim 22, wherein the controller interrupts power to the microwave generators periodically during rise of surface temperatures to the predetermined selectable temperatures.

24. The apparatus of claim 23, wherein the controller controls rest periods with no microwaves for dispersing temperatures away from hot spots and avoiding hot spots, discoloration and burns.

25. The apparatus of claim 22, further comprising an auxiliary heater connected to the chamber for maintaining cure temperatures within the chamber while dissipating heat build up in highly heated areas of the garments by the ambient chamber temperatures.

26. The apparatus of claim 22, further comprising a secondary high temperature cutoff switch connected to the chamber for preventing runaway temperature conditions.

27. The apparatus of claim 22, wherein the controller controls the auxiliary heater, the process time, the microwave generator off periods for rest and heat dispersion, and termination of the entire cycle.

28. The apparatus of claim 27, wherein the controller controls the microwave generators and the auxiliary heater in response to sensed garment surface temperatures irrespective of garment construction, weight of fabric, color or number of garments being cured.

* * * * *